US007960574B1

(12) United States Patent
Dickey et al.

(10) Patent No.: US 7,960,574 B1
(45) Date of Patent: Jun. 14, 2011

(54) METHODS OF SEPARATING OIL FROM OIL-CONTAINING SEEDS

(75) Inventors: Leland C. Dickey, Blue Bell, PA (US); Michael F. Dallmer, Philadelphia, PA (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 841 days.

(21) Appl. No.: 12/002,934

(22) Filed: Dec. 19, 2007

(51) Int. Cl.
*C11B 1/00* (2006.01)

(52) U.S. Cl. ..... 554/11; 554/8; 554/9

(58) Field of Classification Search ..... 554/8, 9, 554/11

See application file for complete search history.

(56) References Cited

OTHER PUBLICATIONS

Dickey, L.C. et al. "Separation of Buoyant Particles from an Aqueous Dispersion of Corn Germ Particles Using a Bubble Column", Chemical Engineering Science, vol. 63, 2008, pp. 4555-4560.
Suzuki, Y. et al., "Removal of Emulsified Oil from Water by Coagulation and Foam Separation", Separation Science and Technology, vol. 40, 2005, pp. 3407-3418.
Karlovic, DJ et al., "Corn Germ Oil Extraction by a New Enzymatic Process", Acta Alimentaria, vol. 23, (4), 1994, pp. 389-400.
Johnston, D.B. et al., "Composition and Economic Comparison of Germ Fractions from Modified Corn Processing Technologies," JAOCS, vol. 82, (8), 2005, pp. 603-608.
Moreau, R.A. et al., "Pressurized Liquid Extraction of Polar and Nonpolar Lipids in Corn and Oats with Hexane, Methylene Chloride, Isopropanol, and Ethanol", JAOCS, vol. 80, (11), 2003, pp. 1063-1067.
Moreau, R.A. et at, "A Comparison of Commercial Enzymes for the Aqueous Enzymatic Extraction of Corn Oil from Corn Germ", JAOCS, vol. 81, (11), 2004, pp. 1071-1075.
Singh, V. et al., "Economics of Germ Preseparation for Dry-Grind Ethanol Facilities", Cereal Chemistry, vol. 74, (4), 1997, pp. 462-466.
Taylor, F. et al., "Dry-Grind Process for Fuel Ethanol by Continuous Fermentation and Stripping", Biotechnology Process, vol. 16, Mar. 27, 2000, pp. 541-547.
Sineiro, J. et al., "Microstructural Features of Enzymatically Treated Oilseeds", J. Sci. Food Agric., vol. 78, 1998, pp. 491-497.
Sada, E. et al., "Influences of Suspended Fine Particles on Gas Holdup and Mass Transfer Characteristics in a Slurry Bubble Column", AIChE Journal, vol. 32, (5), 1986, pp. 853-856.
Sada, E. et al., "Gas Holdup and Mass-Transfer Characteristics in a Three-Phase Bubble Column", Ind. Eng. Chem. Process Des. Dev., vol. 25, 1986, pp. 472-476.
Hadjiev, D. et al., "Phase Inversion: A Method for Separation of Fine Liquid-Liquid Dispersions", Chemical Engineering Journal, vol. 58, 1995, pp. 45-51.
Heiser, N., "Coal Flotation Technical Review", Australian Coal Review, Oct. 1996, pp. 35-36.
McElroy, A.K., "Corn Oil Extraction Opens New Markets", http://distillersgrainsquarterly.com/articlejsp?articie_id=1138.
Dickey, L.C. et al., "Oil Separation from Wet-Milled Corn Germ Dispersions by Aqueous Oil Extraction and Aqueous Enzymatic Oil Extraction", Industrial Crops and Products, vol. 27, 2008, pp. 303-307.

*Primary Examiner* — Deborah D Carr
(74) *Attorney, Agent, or Firm* — John D. Endo; G. Byron Stover

(57) ABSTRACT

Methods of separating oil from oil-containing seeds, involving aerating an aqueous dispersion of germ particles of oil-containing seeds (e.g., corn) to produce bubbles therein, whereby the oil in the aqueous dispersion adheres preferentially to the surfaces of the bubbles and are carried by the bubbles to the upper surface of the aqueous dispersion where a foam of the bubbles is formed; separating the foam from the aqueous dispersion; and recovering the oil from the foam. The aqueous dispersion of germ particles of oil-containing seeds may be produced by mixing corn germ separated from corn kernels with an aqueous acetate buffer followed by heating, grinding, cooling, and optionally agitation; generally cellulase is added after the grinding.

9 Claims, 5 Drawing Sheets
(2 of 5 Drawing Sheet(s) Filed in Color)

METHODS OF SEPARATING OIL FROM OIL-CONTAINING SEEDS

BACKGROUND OF THE INVENTION

The present invention relates to methods of separating oil from oil-containing seeds, involving aerating an aqueous dispersion of germ particles of oil-containing seeds (e.g., corn) to produce bubbles therein, whereby the oil in the aqueous dispersion adheres preferentially to the surfaces of the bubbles and are carried by the bubbles to the upper surface of the aqueous dispersion where a foam of the bubbles is formed; separating the foam from the aqueous dispersion; and recovering the oil from the foam. The aqueous dispersion of germ particles of oil-containing seeds may be produced by mixing corn germ separated from corn kernels with an aqueous acetate buffer followed by heating, grinding, cooling, and optionally agitation; generally cellulase is added after the grinding.

Corn oil is currently extracted from the germ products of dry- and wet-milled corn by hexane extraction or by pressing with specially designed screws (expellers). The plants which use these methods were built to produce higher value products (e.g., food and starch) in comparison to plants making ethanol, and the germ separation and oil extraction (which sometimes occurs in a separate plant) is secondary to large grit (dry-mill) or clean starch (wet-mill) products. As a result of the recent construction of a large number of dry grind (DG) ethanol plants there is a significant amount of corn oil in corn germ available for separation from the ethanol-coproduct called distillers dry grains. About 3.5 million liters of corn oil can be obtained annually from a typical DG plant by centrifuging the concentrated stillage, although centrifugation is energy intensive. More and higher quality oil can be separated from the corn prior to fermentation to make fuel ethanol; however, the front end separation capital cost is as much as ten times higher than separation after fermentation (McElroy, A., Corn oil extraction opens new markets, Distillers Grains Quarterly, 1st Quarter 2007), mainly because front end corn fractionation requires the germ to be separated from the rest of the kernel which is not usually done. Thus currently used oil separation methods have sufficiently high capital costs to discourage retrofitting DG plants for front end germ separation and oil extraction. New germ separation methods have been developed to a pilot scale (Singh, V., and S. Eckhoff, S., Cereal Chem., 74(4): 462-466 (1997); Johnston, D., et al., J. Am. Oil Chem. Soc., 82(8): 603-608 (2005)) but there remains a need for a low cost process to recover oil from germ.

SUMMARY OF THE INVENTION

In accordance with the present invention there is provided methods of separating oil from oil-containing seeds, involving aerating an aqueous dispersion of germ particles of oil-containing seeds (e.g., corn) to produce bubbles therein, whereby the oil in the aqueous dispersion adheres preferentially to the surfaces of the bubbles and are carried by the bubbles to the upper surface of the aqueous dispersion where a foam of the bubbles is formed; separating the foam from the aqueous dispersion; and recovering the oil from the foam. The aqueous dispersion of germ particles of oil-containing seeds may be produced by mixing corn germ separated from corn kernels with an aqueous acetate buffer followed by heating, grinding, cooling, and optionally agitation; generally cellulase is added after the grinding.

BRIEF DESCRIPTION OF THE DRAWINGS

The patent or application file contains at least one drawing executed in color. Copies of this patent or patent application publication with color drawing(s) will by provided by the Office upon request and payment of the necessary fee.

DETAILED DESCRIPTION OF THE INVENTION

The present invention concerns a method of separating oil from oil-containing seeds (e.g., corn), involving aerating an aqueous dispersion of germ particles of oil-containing seeds to produce bubbles therein, whereby the oil in the aqueous dispersion adheres preferentially to the surfaces of the bubbles and are carried by the bubbles to the upper surface of the aqueous dispersion where a foam of the bubbles is formed; separating the foam from the aqueous dispersion; and recovering the oil from the foam (for example with centrifugation). The aqueous dispersion of germ particles of oil-containing seeds is produced by mixing the germ separated from oil-containing seeds (e.g., corn) with an aqueous buffer followed by heating, grinding, cooling, and optionally agitation (agitation is preferred); cellulose or other germ structure degrading enzymes are preferably added after the cooling. The oil-containing seeds may be corn germ or any of the traditional oil seeds such as soybeans, cottonseeds, olives, rapeseeds (canola), flaxseed, palm, or coconut pulp.

The present invention utilizes gas flotation to produce foam containing buoyant oil particles in order to collect oily material in a floating mass which is removed (e.g., skimmed) from the surface of an agitated aqueous dispersion of germ particles (e.g., from corn). Without being bound by theory, as the bubbles rise and are removed at the top of the column shown in FIGS. 1 and 2, the oil droplets on their surface may coalesce more readily due to the movement of the bubble surface through the aqueous dispersion which later enables their separation (e.g., during centrifugation). During agitation (churning) the dissolved endogenous surfactant protein from the germ (e.g., corn) collects at the surface of the rising bubbles, stabilizes them, and these bubbles form a foam layer at the top of the aqueous dispersion.

Figure 3:
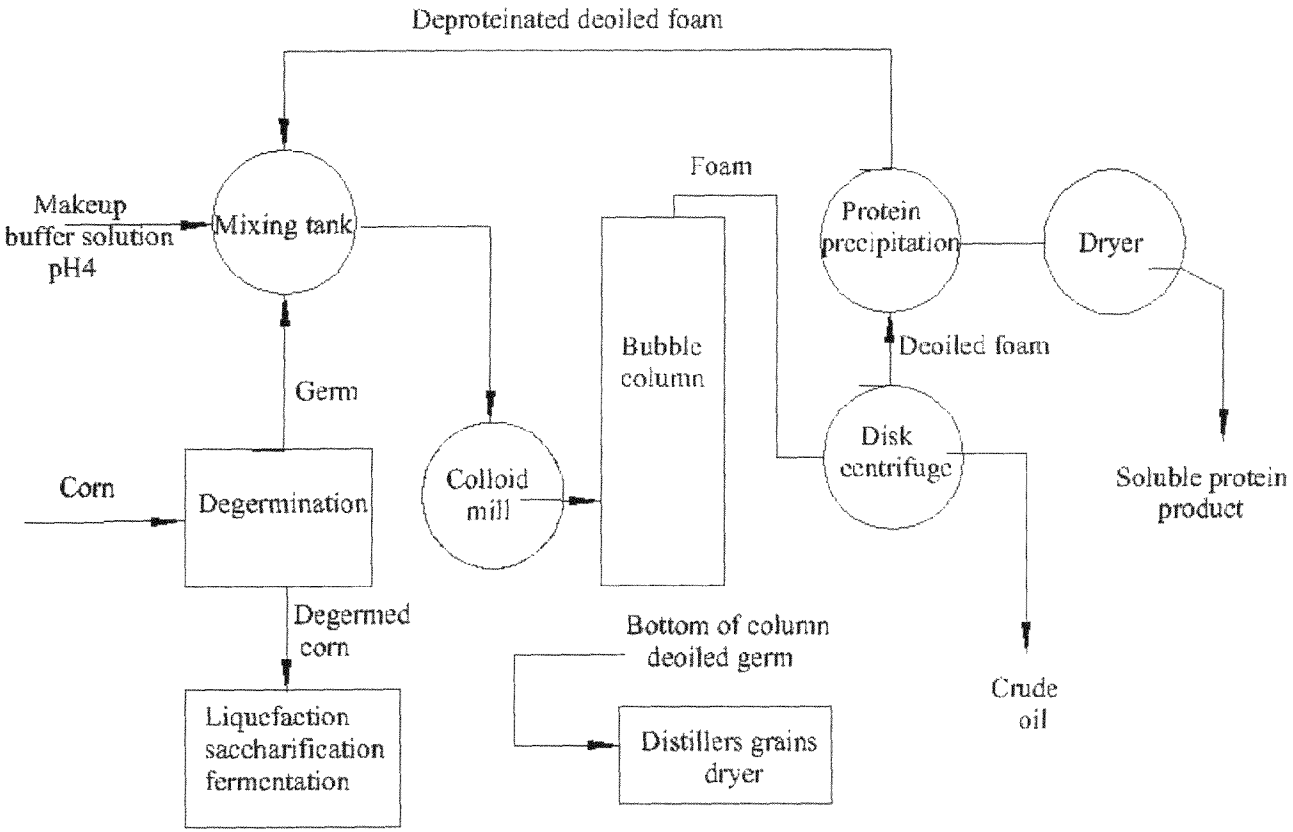
FIG. 3 shows an example of a foam separation system as part of a corn milling plant.

An aqueous dispersion of corn germ particles or particles of oil-containing seeds (e.g., soybeans) is prepared by mixing the germ for about one to about two minutes (e.g., one-two minutes), preferably for about one minute (e.g., one minute), with an aqueous buffer chosen to fix the pH at a value that optimizes the effectiveness of the subsequently added enzyme. For example a10-fold mass of 3% aqueous acetate buffer (pH 4.1) is best to use with GC Multifect® enzyme (Genecor International) which is basically a cellulase enzyme; however a citric acid buffer will maintain the pH at 5.0 which is the preferred value for the GC220 enzyme. The enzyme manufacturer usually specifies the optimal range of pHs for the enzyme product's maximum activity to break down a chemical structure, for example a cellulase is used to degrade cellulose, a protease is used to degrade protein. Commercial enzyme products are mixtures of enzymes generally obtained by extraction from microbial broths, and the best one for degrading a particular substrate must be determined by routine experimentation. Heating also helps break down the substrate (oil seed or corn germ) structure; for example, boiling for about 10 minutes (e.g., 10 minutes) is useful in the case of cellulose, hotter temperatures and longer heating times are limited by burning of the substrate and cost of heating. However, using proteases such as Alcalase® at a pH of 8, obtained using a 4M potassium phosphate dibasic buffer, one can obtain yields of 70-80% of the hexane extracted oil without heating the germ prior to enzyme addition. When heating is used to degrade germ structure prior to grinding, generally a range of about 90° to about 140° C. (e.g., 90°-140° C.) for about 10 to about 60 minutes (e.g., 10-60 minutes) is effective, preferably about 122° C. (e.g., 122° C.) for about 20 minutes (e.g., 20 minutes) for example in a pressure vessel, followed by grinding the mixture generally for about 1 to about 5 minutes (e.g., 1-5 minutes), preferably for about 3 minutes (e.g., 3 minutes). A small amount of buffer solution can be used to rinse the mill if material is left in it for batch processing in for example a colloid mill. After grinding the germ to a median particle size less than about 1 mm (e.g., less than 1 mm) and preferably less than about 300 microns (e.g., less than 300 microns) and then cooling to a temperature which will not degrade the enzyme that will be added next, for example about 50° C. (e.g., 50° C.) for cellulase, an amount of cellulase solution (e.g., cellulase solutions extracted from the fungus *Trichoderma reesei*) from about 5% to about 20% (e.g., 5-20%) of the germ mass being extracted, preferably equal to about 10% (e.g., 10%), is added to break down germ matrix constituents (before subsequent agitation) and the dispersion is transferred to the oil separation system shown in FIG. 1; addition of the cellulase solution is optional but preferred. The dispersion may be added either to the bubble column or the mixing vessel (agitation takes place in both) which, for example, is attached to the column in a dispersion-recycle configuration but for continuous processing will be upstream of the bubble column. FIG. 3 shows an example of a foam separation system as part of a corn milling plant.

Figure 1:
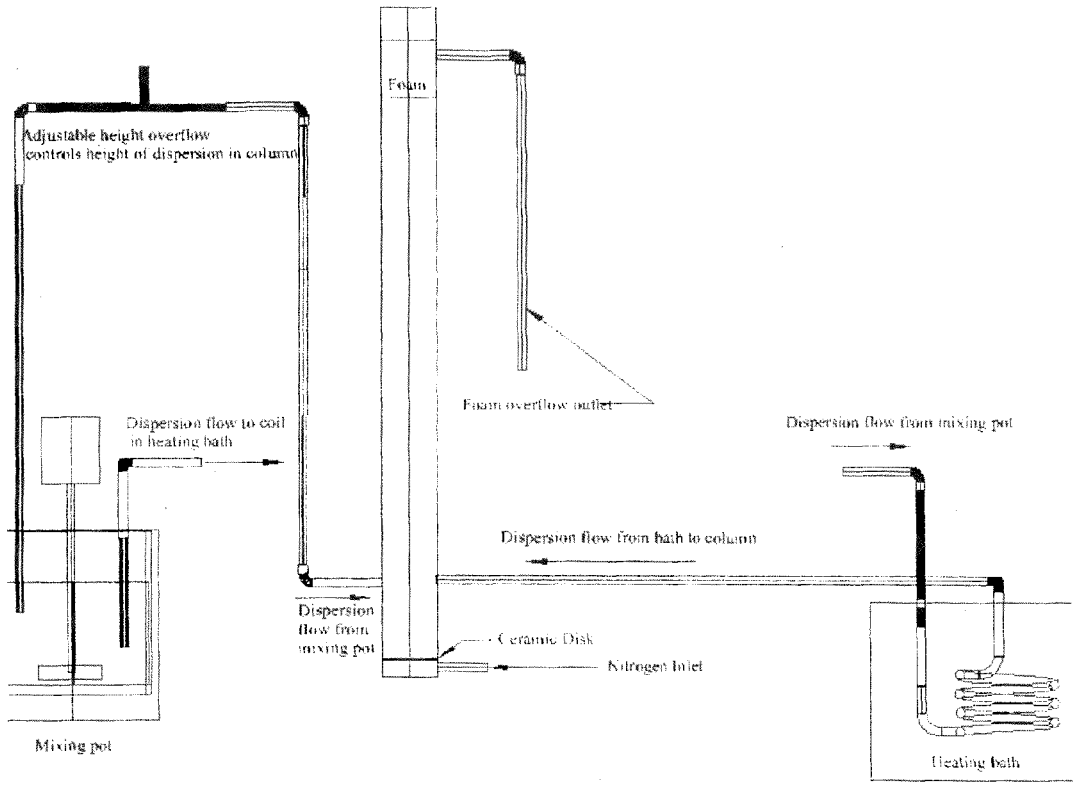
FIG. 1 shows a schematic drawing of a foam separation system.
Figure 2:
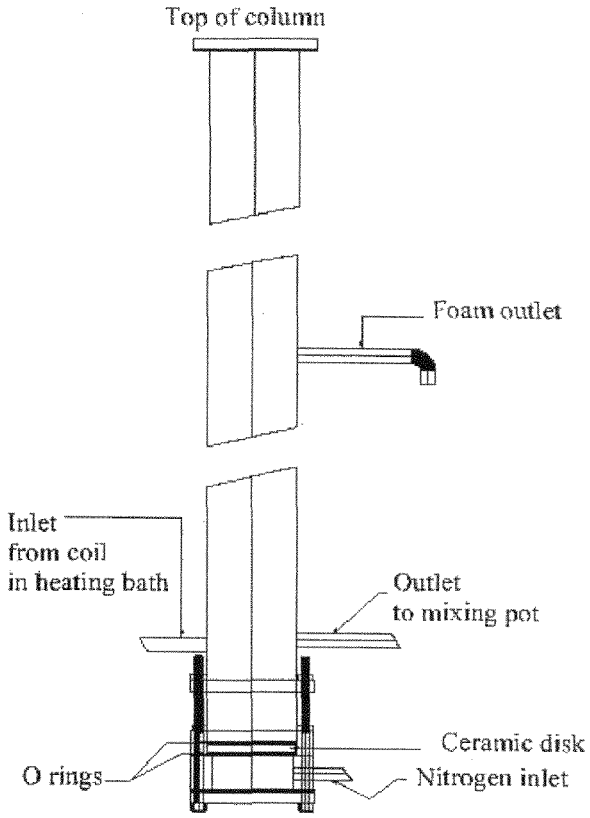
FIG. 2 shows a bubble column.

Buoyant particles are separated in the bubble column shown in FIGS. 1 and 2. The bubble column is a vertical hollow cylindrical tube (e.g., 7.0 cm i.d. and 1.16 m height) mounted above a disk (e.g., 8 cm in diameter) having pores with a pore size of about 10 to about 16 microns (e.g., 10-16 microns; about 42% (e.g., 42%) pore volume). The column sits above the disk which is contained in a holder (e.g., acrylic) machined with a cylindrical hole (e.g., 8 cm) in it so that the disk fits snugly into the holder. The holder has o-rings (e.g., 8 cm o.d.) above and below the disk to insure that a gas (e.g., nitrogen), which is admitted to a chamber below the disk, cannot flow around the disk. The bubble column can be made of acrylic or other well known materials such as glass, thermoplastics that resist oil at the temperatures used in the system (e.g., 50° C.), stainless steel, or ordinary steel cylinders internally coated to resist the mildly acidic dispersion, and the disk can be made of any material (e.g., ceramic) compatible with the dispersion and temperature used as long as it has a pore size of about 10 to about 16 microns (e.g., 42% pore volume). The pressure differential across the disc must be sufficient to overcome the pore resistance of the disk and the head of liquid above the disk, typically this will be about 1 to about 10 mbar (e.g., 1-10 mbar) plus the height of the column of dispersion above the disk, preferably about 65 mbar (e.g., 65 mbar). Nitrogen gas or any gas that does not oxidize the germ or oil at the bubbling temperature is admitted from a continuous supply to a chamber beneath the disk. The flow rate will be proportional to the column area, for example about 0.2-2 (e.g., 0.2-2) scfh (standard cubic foot per hour), preferably about 1 (e.g., 1) scfh for a 7 cm i.d. column. The lowest gas flow rate necessary to have foam overflow of about 200 to about 500 g/h (e.g., 200-500 g/h) for a 7 cm i.d. column (or proportional to the area of the column), preferably about 300 g/h (e.g., 300 g/h), is utilized; this may need to be raised as the amount of dispersion drops when extracting a batch of germ. The gas flow rate needs to be in the so-called homogeneous regime characterized by small, uniform-sized bubbles in the lower end of the column (e.g., above the disk and at the upper surface of the disk); that is the flow rate should be low enough that bubbles which form at the upper surface of the disk do not grow as a result of merging but only grow due to decreased pressure as they rise in the column. The bubbles are spread throughout the fluid (i.e., aqueous dispersion of germ particles) randomly providing as homogeneous a distribution as possible without extra mixing. At a higher flow rate, where the regimes are transitional (1-1.5 cm/s, superficial velocity) and heterogeneous (>1.5 cm/s), the bubbles would merge and create pulses of gas which would create a very unstable interface at the top of the fluid. The top of the column is covered (e.g., with an acrylic plate which could be removed for disassembly and cleaning) and the gas from collapsed bubbles and foam exit the column through a port above (e.g., about 76 cm) the disk. The foam is removed, for example through a foam overflow outlet.

The dispersion can initially be pumped into the column or into the mixing pot shown in FIG. 1. The system generally operates as follows: To pump the dispersion into the system', the tube connecting the heating bath and column is separated into two parts where a quick-disconnect coupling is located and the dispersion is pumped into the column through one end of the separated tubing. As the column fills in excess of the volume up to the height of the overflow tee (1.3 liter) the dispersion will overflow (backward to its flow direction during churning and bubbling) into the mixing pot. After the dispersion (typically 4500 g) has been transferred, the disconnected tubing will be restored and the tubing pump which pumps dispersion from the mixing pot to the coil in the heating bath at 300 ml/min is turned on. The dispersion flow through the system mixes it, as well as the stirrer agitation in the approximately 4 liter mixing pot. When the dispersion is flowing through the system the valves controlling the flow of nitrogen to the bottom of the column are opened and the gas bubbles up through the ceramic disk through the dispersion (as bubbles) and out with the foam and as part of the foam through the foam overflow outlet. The foam draining through the overflow outlet is collected in a container, weighed and subsequently centrifuged. The foam overflow rate can be increased by raising the liquid level in the column by raising the overflow tee whose height is adjustable. The overflow rate is also dependent on the nitrogen flow rate as a higher bubble flow increases the bubble volume in the column and raises the height of the top of the dispersion and entrains foam flow out of the column with higher nitrogen flow. This process is continued until the foam no longer contains a significant amount of oil. Typically half the oil in the original germ (e.g., corn) can be recovered as a separate oil layer after centrifugation and another 25% of the original oil is in the centrate. In total the collected foam contains ¾ of the original oil in ¼ the mass of the dispersion. The system may be modified (e.g., sized up) by routine experimentation.

Exogenous surfactant may be added to the dispersion to promote foaming. Generally no exogenous surfactant is added.

The oil may be separated from the foam for example by centrifuging the collected foam which also removes non-buoyant solid particles. If the foam is centrifuged for an insufficient period, an opaque layer of fines and oil will remain under the clear oil layer; the opaque layer can be almost completely eliminated by additional centrifugation. The oil layer is removed, for example by skimming of the upper layer using conventional, continuous oil separation technology such as lamellar settlers. Oil content of the collected foam can be maximized by churning the germ dispersion for a period of time sufficient to allow full digestion by the enzyme prior to foam collection.

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are now described.

The following examples are intended only to further illustrate the invention and are not intended to limit the scope of the invention as defined by the claims.

EXAMPLES

Dispersion preparation: The corn germ utilized was wet-milled germ provided by a grain milling company. An aqueous dispersion of corn germ particles was prepared by mixing the germ for a minute with a 10-fold mass of 3% aqueous acetate buffer (pH 4.1), heating to 122° C. in a pressure cooker for 20 minutes and grinding the mixture for 3 min with additional buffer in a colloid mill (Eppenbach 4535, Long Island City, N.Y.) set at its narrowest blade/stator clearance. After grinding and then cooling to 50° C., an amount of Multifect® GC cellulase solution (Genecor International) equal to 10% of the germ mass was added to break down germ matrix constituents (before subsequent agitation) and the dispersion was transferred to the oil separation system shown in FIG. 1; the dispersion may be added either to the bubble column or the mixing pot (agitation takes place in both). A separate dispersion was similarly prepared and used to obtain oil by agitating (churning) in a covered 2 L beaker placed in an incubator shaker at 160 rpm for 23 hours at 70° C.; after several hours of churning, the oil was separated by centrifugation.

Separation of buoyant particles: The bubble column utilized consisted mainly of a vertical cylindrical acrylic tube of 7.0 cm i.d. and 1.16 m height mounted above an 8-cm ceramic disk with a pore size of 10-16 microns (42% pore volume). The column sat above the disk which was contained in an acrylic holder machined with a 8 cm cylindrical hole in it so that the disk fits into the holder. The holder had 8 cm o.d. o-rings above and below the ceramic disk to insure that nitrogen, which was admitted to a chamber below the disk, cannot flow around the disk. The pressure differential across the disc was 10 mbar. Nitrogen gas was admitted from a continuous supply to a chamber beneath the disk through a parallel bank of seven independently adjustable 0.47 L/min maximum rotameter/flow controllers. The flow rate will be proportional to the column area, for our column 0.2-2 scfh is enough. The lowest flow rate necessary to get foam overflow is preferred, this may rise as the amount of dispersion drops. The gas flow rate was in the so-called homogeneous regime characterized by small, uniform-sized bubbles in the lower end of the column (e.g., above the disk and at the upper surface of the ceramic disk); that is the flow rate was low enough that bubbles which formed at the upper surface of the ceramic disk did not grow as a result of merging but only grew due to decreased pressure as they rose in the column. The original bubbles were spread throughout the fluid (i.e., aqueous dispersion of corn germ particles) randomly providing as homogeneous a distribution as possible without extra mixing. At a higher flow rate, where the regimes are transition (1-1.5 cm/s, superficial velocity) and heterogeneous (>1.5 cm/s), the bubbles would merge and create pulses of gas which would create a very unstable interface at the top of the fluid. The top of the column was covered with an acrylic plate (which could be removed for disassembly and cleaning) and the nitrogen gas from collapsed bubbles and foam exited the column through a port 76 cm above the ceramic disk. The foam flowed through a flexible tube into a 2 L beaker supported by an electronic balance (Sartorius model 6201, Goettingen, Germany). The weight of foam collected was measured at regular intervals.

The dispersion can initially be placed into the column or the mixing pot. In this example the column was first filled (which took about 2 minutes) and any overflow dispersion went into the mixing pot. The liquid level in the column was controlled by a height-adjustable tubing connection through which the dispersion flowed by gravity from the column to a jacketed and stirred vessel (mixing pot). The mixing pot functioned as a surge tank, its fluid contents diminished as foam drained from the column; additional water was added to replace foam drained from the column, usually in about 200 ml batches. This configuration produced a steady dispersion level in the column. The 19 cm i.d. stainless steel mixing pot had 2 vertical baffles and started the churning with about 1.3 L of dispersion in it. It was agitated with a six-bladed, 6-cm diameter stirrer at 300 rpm. The dispersion in the column was pumped through flexible tubing at 300 ml/min from the jacketed and stirred vessel and through a coil of copper tubing immersed in a heating bath held at 50° C. (Grant LTD 20, Science/Electronics, Dayton, Ohio).

Separation of oil: The collected foam was centrifuged using a swinging basket type centrifuge (IEC, Boston, Mass.) at 6000×g for 60 min to remove non-buoyant solid particles. If the foam was centrifuged for an insufficient period, an opaque layer of fines and oil remained under the clear oil layer; the opaque layer could be almost completely eliminated by additional centrifugation. After centrifugation, the centrate was frozen and free oil paste scraped from the ice with a spatula. The freezing/scraping method was easier and more reliable than pipetting the oil from the centrate because of the small amount of free oil. Freezing would not be used on a larger scale, but instead skimming of the upper layer using conventional, continuous oil separation technology such as lamellar settlers. After removal from the ice, the oil paste was melted, lyophilized using a Freezemobile 12XL (Virtis, Gardiner, N.Y.), weighed, and the oil fraction determined by hexane extraction (Moreau, R., et al., J. Am. Oil Chem. Soc., 80 (11): 1063-1066 (2003)). The centrate (after initial removal of the oil as described above) and the solid precipitated by centrifugation were also dried, weighed and analyzed for oil and protein. Oil recovered from the centrate was termed fines oil in the figures; it was oil that was in droplets too fine to be driven to the free oil layer by the centrifugation.

Reuse of foam centrate: Observation of the foam during churning revealed that after about 6 h the foam was so thin that the dispersion level needed to be raised (by raising the overflow tee) to within 1 or 2 cm of the outlet port to obtain a useful foam flow rate from the column. Initially the level was 8-10 cm below the port.

Figure 4:
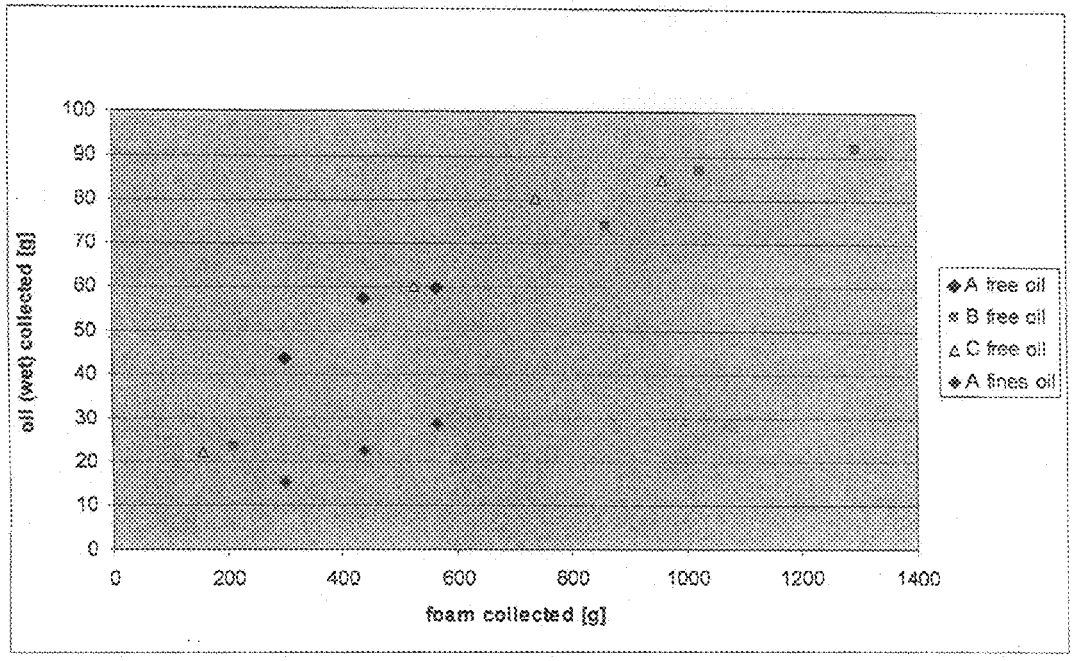
FIG. 4 shows oil yields obtained by foaming method. Dispersion created from: (A) 300 g germ and 30 g of enzyme solution, (B) 400 g of germ and 40 g of enzyme solution, (C) 400 g of germ and 60 g of enzyme solution.

Results and discussion: We obtained 26.9 g of oil per 100 g of germ (wet milled germ kept in cold storage for six months) using the incubator/shaker method. Using the foaming method and bubble column described above and germ from the same source we obtained 60.0 g of free oil and 28.5 g of oil in fine droplets from 300 g of germ and 30 ml of enzyme in 9 h at 50° C. (run A in FIG. 4). The germ originally contained 40% oil and therefore 73% of the oil was transferred to the collected foam and 22% of the oil was left at the bottom of the bubble column with non-buoyant solid particles or coated internal equipment surfaces. Runs B and C both used 400 g of germ but C used 50% more enzyme than B (60 ml), and the oil yield similarity of this run to the others indicated that an enzyme solution mass 10% of the germ mass was sufficient. Unlike runs B and C, the oil yield for the run A plot peaked at 600 g of collected foam. The lower limit for plot A can be attributed to its lower dispersion mass. Foam was collected only until about 3.2 L of dispersion was left in the column/heat bath/stirred pot; thereafter insufficient fluid remained in the line between the column and bath to fill the tube connecting the column and heat bath. A run in which 300 g of germ was extracted without enzyme produced only 3 g of oil. This was consistent with results observed with the incubator/shaker method showing that oil yield increased monotonically with enzyme use, peaking at 10% of germ mass.

Figure 5:
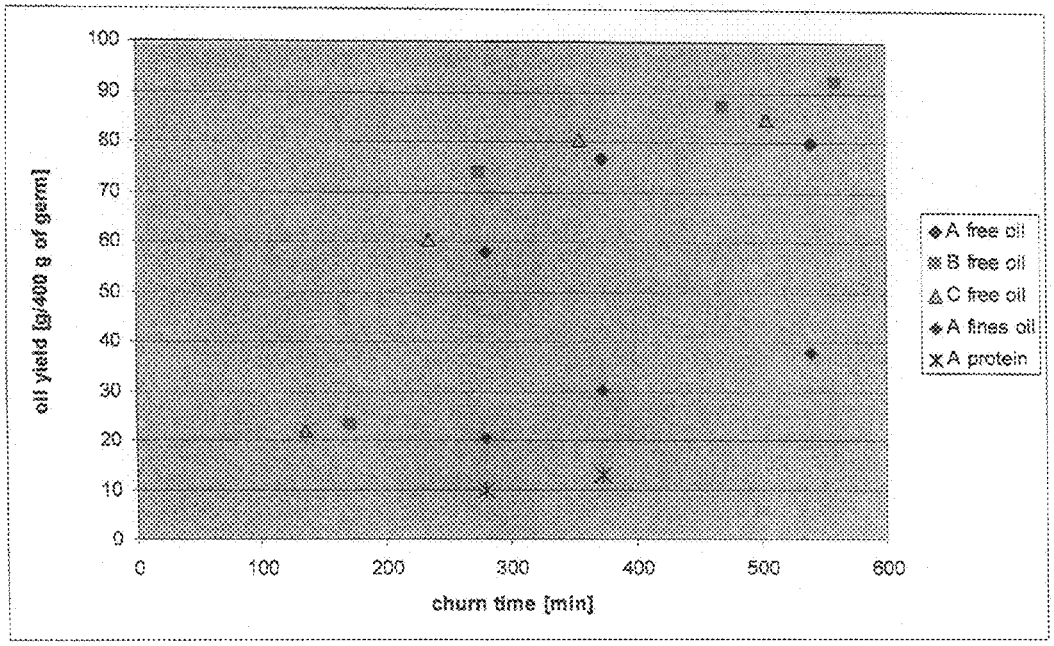
FIG. 5 shows oil yields/400 g of germ trend with time. Dispersion created from: (A) 300 g of germ and 30 g of enzyme solution, (B) 400 g of germ and 40 g of enzyme solution, (C) 400 g of germ and 60 g of enzyme solution.

Oil yields per 400 g of germ (FIG. 4) increased with churning time and mass of foam collected for 3 h. However, although the oil fraction of the foam was steady, after 3 h the foam became weaker and the oil yield decreased (FIG. 5). Nitrogen was bubbled through the C dispersion at a low flow rate, usually 0.25 scfh (standard cubic foot per hour), for 25 min prior to raising it to the usual rate of 1 scfh and collecting overflowing foam. The churning time used to plot the run C yield trend in FIG. 5 included this 25 min period. The similarity of the plots of B and C in FIG. 5 (C included the churning without foam-collecting period) was consistent with foam generation faster than oil capture by the foam (that is, the delay in collecting foam for run C did not change the oil yield since it was limited by other aspects of the process such as producing buoyant oil drops that the foam could incorporate). This follows if both surfactant and oil droplets were released from the germ by the enzyme treatment at about the same rate but the droplets had to churn for an additional coalescence period to reach buoyant size and become foam portable.

In these experiments, droplet coalescence occurred mainly in the mixing pot whose operation was not changed. Oil droplet coalescence was oil collection rate limiting for the later parts of the runs (B for example was 3.8 g of oil/h). During the early part of the same run, oil was recovered with the collected foam at 29 g of oil/h. In early, high rate period there were enough oil drops in the dispersion that their production did not limit oil collection. The early rate was controlled by drop incorporation into the foam or foam creation with endogenous surfactant.

As shown in FIG. 5, the germ surfactant (protein) mass cannot be more than half the oil mass remaining in the foam water; the maximum would apply if all of the measured protein was surface active. In the germ extractions the pH of 4 was chosen to optimize the cellulase activity and not foam stability, since enzyme digestion of the germ appeared to be the ultimate rate limiting process in the separation. Therefore the endogenous surfactant released from the germ was fortuitously good at producing foam.

A one hour centrifugation test was made which showed that to separate nearly all the free oil drops from comingled fine particles in a collected foam sample, the centrifuge cannot be run substantially slower than full speed, 6000 rpm, which corresponded to the maximum g force for a continuous decanter. Centrifugation is expensive and this finding emphasizes the process cost significance of concentrating the oil in a minimum volume (of collapsed foam) prior to centrifugation.

The bubble column and mixing pot functioned as a vessel in which the dispersed particles were digested and oil droplets coalesced into buoyant drops. A new method to separate buoyant particles from the germ dispersion by carrying them from the top of a bubble column with a stream of foam was demonstrated. The enzymatic digestion of the germ was slower than the removal of oil drops from the dispersion with the foam. Therefore to minimize the cost of centrifuging the collected foam it is preferable to produce foam with the maximum oil content by maintaining the foam collection rate equal to the rate of buoyant oil drop creation. Although the tests were carried out with corn germ, the method can be applied to aqueous extractions of any oil seed; for example the method could be applied to other oil-containing mixtures from which oil would be subsequently separated by centrifugation or other expensive steps. For example, continuous fermentation processes described by Taylor (Taylor, F., et al., Biotechnol. Prog., 16: 541-547 (2000)) will generate a stream composed of the fermentation broth which will contain all of the oil from the corn fed to the process. The fermentation must be carried out without addition of proteases, which are sometimes used to avoid adding nitrogenous nutrients (for the yeast) but which sacrifice the recovery of soluble protein including the surfactant needed for foam separation of oil. The oil could be more economically removed from the fermentation broth if it is concentrated by concentration in a foam fraction prior to centrifugation.

Protein can also be recovered from the germ as well as the oil since the protein appears to be even more concentrated in the foam. About ¾ of the protein was recovered in the foam which was typically only 30% of the dispersion mass. The protein resided in the liquid below the oil layer created by centrifugation. It could be separated from the water and other solutes by precipitation or by evaporating the water. The protein can be used in a protein enriched feed.

All of the references cited herein, including U.S. Patents, are incorporated by reference in their entirety. Also incorporated by reference in their entirety are the following references: Dickey, L. C., M. J. Kurantz, and N. Parris, Oil separation from wet milled corn germ dispersions by aqueous oil extraction and aqueous enzymatic oil extraction, accepted for publication by Industrial Crops and Products (2008)), a copy of which is attached to this application; Hadjiev, D. and Y. Aurelle, The Chemical Engineering Journal, 58: 45-51 (1995); Jamialahmadi, M., and H. Muller-Steinhagen, Canadian Journal of Chemical Engineering, 69(11): 390-393 (1991); Johnston, D., et al., J. Am. Oil Chem. Soc., 82(8): 603-608 (2005); Karlovic, D., et al., Acta Aliment., 23(4): 389-400 (1994); McElroy, A., Corn oil extraction opens new markets, Distillers Grains Quarterly, 1st Quarter (2007); Moreau, R., et al., J. Am. Oil Chem. Soc., 80(11): 1063-1066 (2003); Moreau, R., et al., J. Am. Oil Chem. Soc., 81(1): 77-84 (2004); Sada, E., et al., Industrial and Engineering Chemistry Process Design and Development, 25(2): 472-476 (1986); Sada, E., et al., AIChE Journal, 32(5): 853-856 (1986); Sineiro, J., et al., J. Sci. Food Agric., 78(4): 491-497 (1998); Singh, V., and S. Eckhoff, Cereal Chem., 74(4): 462-466 (1997); Suzuki, Y., and T. Maruyama, Separation Science and Technology, 40(16): 3407-3418 (2005); Taylor, F., et al., Biotechnol. Prog., 16: 541-547 (2000).

Thus, in view of the above, the present invention concerns (in part) the following:

A method of separating oil from oil-containing seeds, comprising (or consisting essentially of or consisting of) aerating an aqueous dispersion of germ particles of oil-containing seeds to produce bubbles therein, whereby the oil in said aqueous dispersion adheres (preferentially) to the surfaces of said bubbles and are carried by said bubbles to the upper surface of said aqueous dispersion where a foam of said bubbles is formed; separating said foam from said aqueous dispersion; and recovering said oil from said foam.

The above method, wherein said oil-containing seeds are selected from the group consisting of corn, soybeans, cottonseeds, olives, rapeseeds, flaxseed, palm, coconut, and mixtures thereof. The above method, wherein said oil-containing seeds are corn.

The above method, wherein said aqueous dispersion of germ particles of oil-containing seeds is produced by mixing corn germ separated from corn kernels with an aqueous buffer followed by heating, grinding, cooling, and optionally agitation. The above method, wherein cellulase is added after said cooling. The above method, wherein said aqueous buffer is aqueous acetate buffer.

The above method, wherein said aqueous dispersion of germ particles of oil-containing seeds is produced by mixing corn germ separated from corn kernels with an aqueous buffer followed by heating, grinding, cooling, and agitation. The above method, wherein cellulase is added after said cooling.

The above method, wherein said method further comprises separating said foam from said aqueous dispersion and recovering protein from said foam.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

We claim:

1. A method of separating oil from oil-containing seeds, comprising aerating an aqueous dispersion of germ particles of oil-containing seeds to produce bubbles therein, whereby the oil in said aqueous dispersion adheres to the surfaces of said bubbles and are carried by said bubbles to the upper surface of said aqueous dispersion where a foam of said bubbles is formed; separating said foam from said aqueous dispersion; and recovering said oil from said foam.

2. The method according to claim 1, wherein said oil-containing seeds are selected from the group consisting of corn, soybeans, cottonseeds, olives, rapeseeds, flaxseed, palm, coconut, and mixtures thereof.

3. The method according to claim 1, wherein said oil-containing seeds are corn.

4. The method according to claim 3, wherein said aqueous dispersion of germ particles of oil-containing seeds is produced by mixing corn germ separated from corn kernels with an aqueous buffer followed by heating, grinding, cooling, and optionally agitation.

5. The method according to claim 4, wherein cellulase is added after said cooling.

6. The method according to claim 4, wherein said aqueous buffer is aqueous acetate buffer.

7. The method according to claim 4, wherein said aqueous dispersion of germ particles of oil-containing seeds is produced by mixing corn germ separated from corn kernels with an aqueous buffer followed by heating, grinding, cooling, and agitation.

8. The method according to claim 7, wherein cellulase is added after said cooling.

9. The method according to claim 1, wherein said method further comprises separating said foam from said aqueous dispersion and recovering protein from said foam.

* * * * *